US011826814B2

(12) United States Patent
Grumm

(10) Patent No.: US 11,826,814 B2
(45) Date of Patent: Nov. 28, 2023

(54) CAN SEAMING APPARATUS

(71) Applicant: Oktober, LLC, Grand Rapids, MI (US)

(72) Inventor: Dennis Grumm, Grand Rapids, MI (US)

(73) Assignee: OKTOBER, LLC, Muskegon, MI (US)

( * ) Notice: Subject to any disclaimer, the term of this patent is extended or adjusted under 35 U.S.C. 154(b) by 0 days.

(21) Appl. No.: 17/001,387

(22) Filed: Aug. 24, 2020

(65) Prior Publication Data

US 2021/0138526 A1 May 13, 2021

Related U.S. Application Data

(63) Continuation of application No. 15/581,190, filed on Apr. 28, 2017, now Pat. No. 10,751,785.

(60) Provisional application No. 62/330,072, filed on Apr. 30, 2016.

(51) Int. Cl.

| | |
|---|---|
| ***B21D 51/32*** | (2006.01) |
| ***B21D 51/30*** | (2006.01) |
| ***B21D 51/26*** | (2006.01) |

(52) U.S. Cl.

CPC ..... *B21D 51/32* (2013.01); *B21D 51/2653* (2013.01); *B21D 51/2661* (2013.01); *B21D 51/2692* (2013.01); *B21D 51/30* (2013.01)

(58) Field of Classification Search

CPC ..... B21D 51/2653; B21D 51/2661; B21D 51/2692; B21D 51/32; B21D 51/30; B21D 51/2684; B21D 51/2676; B21D 51/28; B65B 7/285; B65B 7/2857

USPC .... 413/2, 4, 6, 26, 27, 31; 53/485, 488, 366

See application file for complete search history.

(56) References Cited

U.S. PATENT DOCUMENTS

| | | | | | |
|---|---|---|---|---|---|
| 690,002 | A * | 12/1901 | Wittebolle | B21D 51/32 | 413/39 |
| 2,023,598 | A * | 12/1935 | Kronquest | B21D 51/32 | 413/39 |
| 2,052,620 | A * | 9/1936 | Guenther | B21D 51/32 | 413/37 |
| 2,137,245 | A * | 11/1938 | Junkunc | B21D 51/32 | 413/39 |
| 9,545,656 | B2 * | 1/2017 | Aldred | B21D 51/32 | |
| 2013/0108399 | A1 * | 5/2013 | Aldred | B21D 51/32 | 413/31 |

FOREIGN PATENT DOCUMENTS

| | | | |
|---|---|---|---|
| KR | 10-2005-0046910 | * | 5/2005 |
| KR | 20050046910 A | * | 5/2005 |

* cited by examiner

*Primary Examiner* — Katrina M Stransky
*Assistant Examiner* — P Derek Pressley
(74) *Attorney, Agent, or Firm* — The Watson IP Group, PLC; Jovan N. Jovanovic

(57) ABSTRACT

A can seaming apparatus including a frame, a can handling assembly, a can driving assembly and a seaming assembly. The can seaming apparatus is configured to seal a lid to a can through a double seam can seal. The can is positioned and clamped between an upper and a lower chuck. The can driving assembly spins the can and the upper and lower chucks about an axis. The seaming assembly includes two rollers which can selectively be directed to engage the can to form the necessary crimping operations.

13 Claims, 16 Drawing Sheets

CAN SEAMING APPARATUS

CROSS-REFERENCE TO RELATED APPLICATION

This application is a continuation of U.S. patent application Ser. No. 15/581,190, filed Apr. 28, 2017, entitled "Can Seaming Apparatus", the entire specification which is hereby incorporated by reference, which claims priority from U.S. Pat. App. Ser. No. 62/330,072 filed Apr. 30, 2016, entitled "Can Seaming Apparatus," the entire disclosure of which is hereby incorporated by reference in its entirety.

BACKGROUND OF THE DISCLOSURE

1. Field of the Disclosure

The disclosure relates in general to a container forming apparatus, and more particularly, to a can seaming apparatus that is configured to form the double seam can seal on a can. While not limited thereto, the apparatus is well suited for the application of a double seam can seal on a typical aluminum beverage can (such as what is known as a beer can). Of course, this is to be deemed exemplary and is not to be deemed limiting.

2. Background Art

The manufacture of cans is known in the art. For example, beverage cans are formed from a lower can portion and an upper can top. With a typical can configuration, the can includes an upper outward flange. The cover includes a cover curl that extends over the end of the flange and below the flange. In a first operation, a roller directs the cover between the flange and the body to form an initial crimp. Next, in a second operation, a second roller flattens the seam to complete the double seam can seal.

While equipment for coupling the upper can top to the can is known, current equipment has many drawbacks. First, much of the available equipment comprises larger equipment that is configured to continuously, and in an automated fashion, seal successive cans. Such equipment is not suitable or efficient for smaller batch production. Moreover, for small batch production, such equipment is too costly to purchase and operate.

Other solutions exist that are more well suited to smaller batch production. Nevertheless, such equipment also has drawbacks. In particular, some such equipment requires extensive training, and may be difficult to operate. Other such equipment, while suitable for smaller batch production, is nevertheless expensive to purchase and operate.

There remains a need for a small, efficient and cost effective can seaming apparatus.

SUMMARY OF THE DISCLOSURE

The disclosure is directed to a can seaming apparatus that includes a frame, a can handling assembly, a can driving assembly and a seaming assembly. The can seaming apparatus is configured to seal a lid to a can through a double seam can seal. The can is positioned and clamped between an upper and a lower chuck. The can driving assembly spins the can and the upper and lower chucks about an axis. The seaming assembly includes two rollers which can selectively be directed to engage the can to form the necessary crimping operations.

In an aspect of the disclosure, the disclosure is directed to a can seaming apparatus comprising a frame, a can handling assembly, a driving assembly and a seam forming assembly. The can handling assembly is associated with the frame. The can handling assembly has a lower end can handling subassembly and an upper can handling subassembly. The lower can handling subassembly including a lower chuck structurally configured to retain a lower rim of a blank of a can. The upper end can handling assembly including an upper chuck structurally configured to retain an upper cap the can. The lower end can handling assembly further including a lower can positioning subassembly structurally configured to raise and lower the lower chuck toward and away from the upper chuck. The can driving assembly is structurally configured to rotate at least one of the upper chuck and the lower chuck. The seaming assembly includes a first seam forming subassembly and a second seam forming subassembly, each movably coupled to the frame, and operable sequentially to form a double seam can seal between the blank and the upper cap.

In some configurations, the lower can handling subassembly further includes an overcenter mechanism to lock the lower chuck into an engaging configuration.

In some configurations, the overcenter mechanism further includes an overcenter handle which is coupled through linkages to the lower chuck. The overcenter handle can be rotated relative to the linkages into the engaging configuration.

In some configurations, the overcenter mechanism further includes an adjustment mechanism structurally configured to adjust the position of the lower chuck relative to the upper chuck in the engaging configuration.

In some configurations, the driving assembly further includes a motor that is operably coupled to the upper chuck, to in turn, facilitate rotation thereof.

In some configurations, the upper chuck is rotatably coupled to the frame, in a fixed position.

In some configurations, the lower chuck and the upper chuck have a collinear axis of rotation.

In some configurations, the first seam forming subassembly further includes a first roller rotatably coupled to a first roller trunnion that is pivotably coupled to the frame about a first pivot axle. The first pivot axle is spaced apart from an axis of rotation of the first roller. A first rotation actuator is configured to rotate the first roller trunnion about the pivot axle, to, in turn, direct the first roller into contact with at least one of the blank and the top cap.

In some configurations, a first roller position adjustment is provided which adjusts the vertical position of the first roller relative to the upper chuck, so as to alter a point of contact on the at least one of the blank and the top cap.

In some configurations, the axis of rotation of the first pivot axle and the first roller is parallel to the axis of rotation of the upper chuck and the lower chuck.

In some configurations, the first rotation actuator comprises a lever that extends from the first roller trunnion.

In some configurations, the second seam forming subassembly further includes a second roller rotatably coupled to a second roller trunnion that is pivotably coupled to the frame about a second pivot axle. The second pivot axle is spaced apart from an axis of rotation of the second roller. A second rotation actuator is configured to rotate the second roller trunnion about the pivot axle, to, in turn, direct the second roller into contact with at least one of the blank and the top cap.

In some configurations, the first pivot axle and the second pivot axle are parallel to each other and parallel to the axis of rotation of the upper and lower chuck.

In some configurations, each of the first and second pivot axles include an adjustment mechanism, adjusting the vertical position of the first roller relative to the upper chuck, and the vertical position of the second roller relative to the upper chuck. As such, the adjustment can alter a point of contact of the first roller and the second roller, respectively, on the at least one of the blank and the top cap.

In some configurations, the first pivot axle is positioned on one side of the upper chuck, and the second pivot axle is positioned on a second side of the upper chuck.

In some configurations, the first roller and the second roller are each configured to contact the at least one of the blank and the top cap on opposite sides.

In some configurations the first roller rotation actuator comprises a lever coupled to the first roller trunnion. Also, the second roller rotation actuator comprise a lever coupled to the second roller trunnion.

In some configurations, the first seam forming subassembly further includes a first pivot limiting assembly limiting the pivoting of the first roller relative to the upper chuck. The second seam forming subassembly further includes a second pivot limiting assembly limiting the pivoting of the second roller relative to the upper chuck.

In some configurations, the first pivot limiting assembly and the second pivot limiting assembly are each adjustable.

In some configurations, the can seaming apparatus may further include a can positioning bracket having an inner edge extending inwardly toward the axis of rotation. The inner edge is outboard of a can positioned and retained by the can handling assembly. In such a manner, the inner edge can be utilized to position the can prior to securing to the upper chuck, whereupon coupling to the upper chuck, the upper chuck moves the can away from the inner edge.

In another aspect of the disclosure, the disclosure is directed to a method of operating a can seaming apparatus comprising the steps of providing a can blank and a top cap; positioning the can blank on the lower chuck; positioning the top cap on the can blank; raising the lower chuck so that the top cap engages the upper chuck and the lower chuck reaches the engaging configuration; locking the lower chuck in the engaging configuration; actuating the driving assembly so as to rotate the lower and upper chucks and the can blank and top cap about an axis of rotation; actuating the first seam forming subassembly to engage the can blank and top cap, deforming the same; disengaging the first seam forming subassembly from the can blank and top cap; actuating the second seam forming subassembly to engage the can blank and top cap, deforming the same; and removing the can blank and top cap which define a formed can.

In some configurations, the method further comprises the steps of leaning the can blank against an inner edge of a can positioning bracket; and directing the can blank away from the inner edge of the can positioning bracket by the upper chuck contacting the top cap during the step of raising, so that in the step of actuating, the can blank is rotated in a spaced apart orientation relative to the inner edge of the can blank.

BRIEF DESCRIPTION OF THE DRAWINGS

The disclosure will now be described with reference to the drawings wherein.

DETAILED DESCRIPTION OF THE DISCLOSURE

Figure 1:
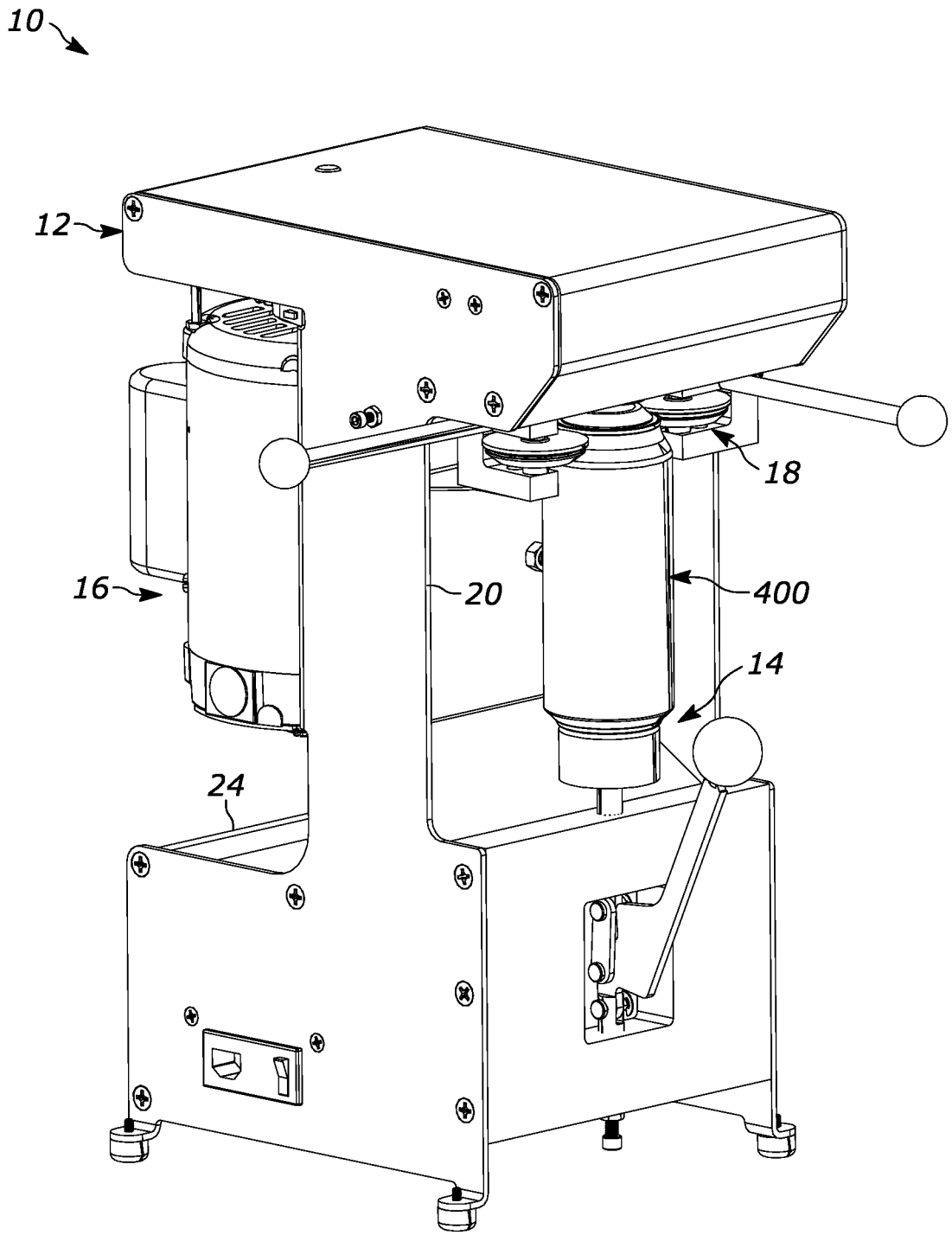
FIG. 1 of the drawings is a perspective view of the can seaming apparatus of the present disclosure.
Figure 2:
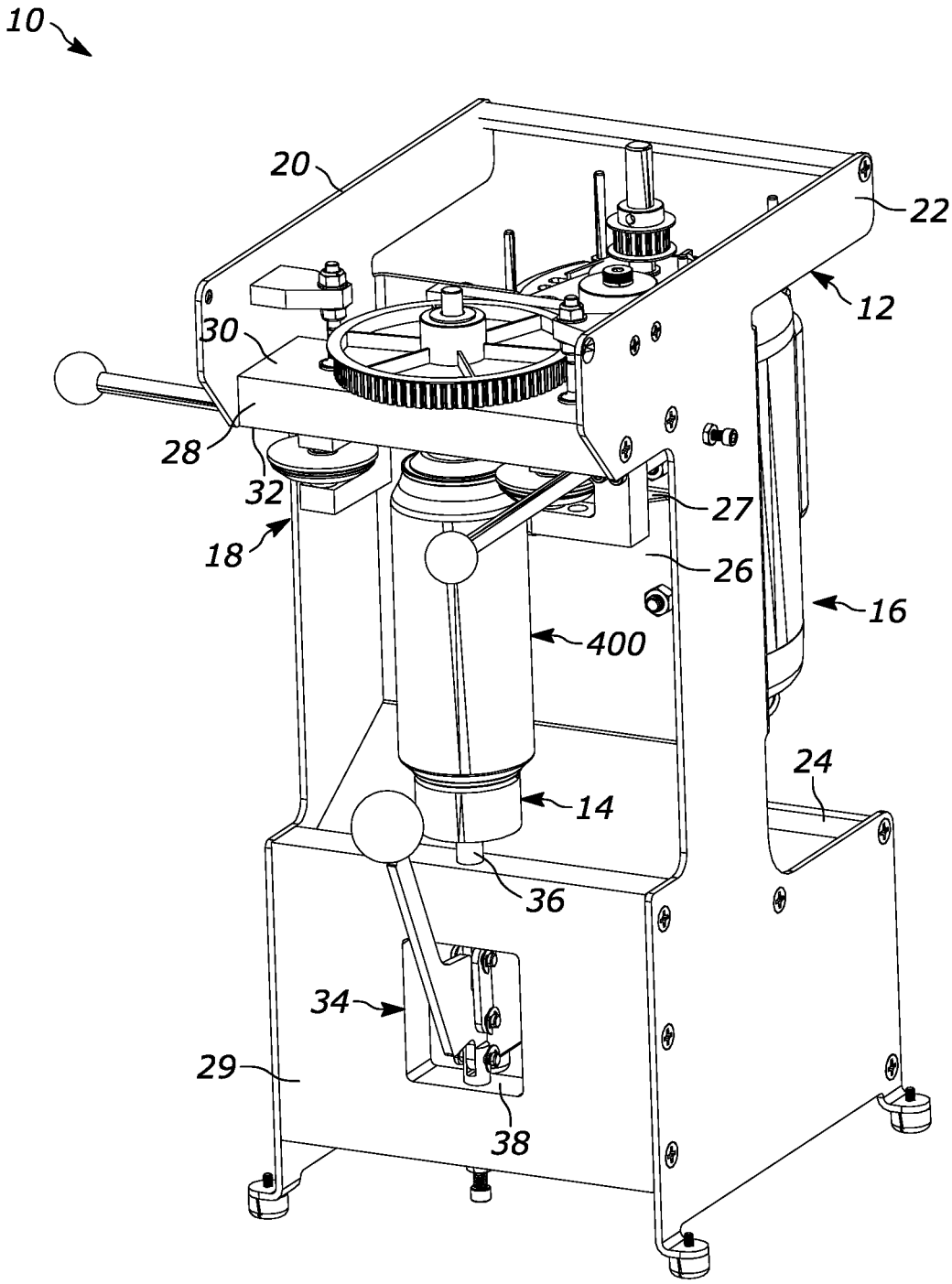
FIG. 2 of the drawings is a perspective view of the can seaming apparatus of the present disclosure, with a portion of a top of the frame removed to show the inner components thereof.
Figure 3:
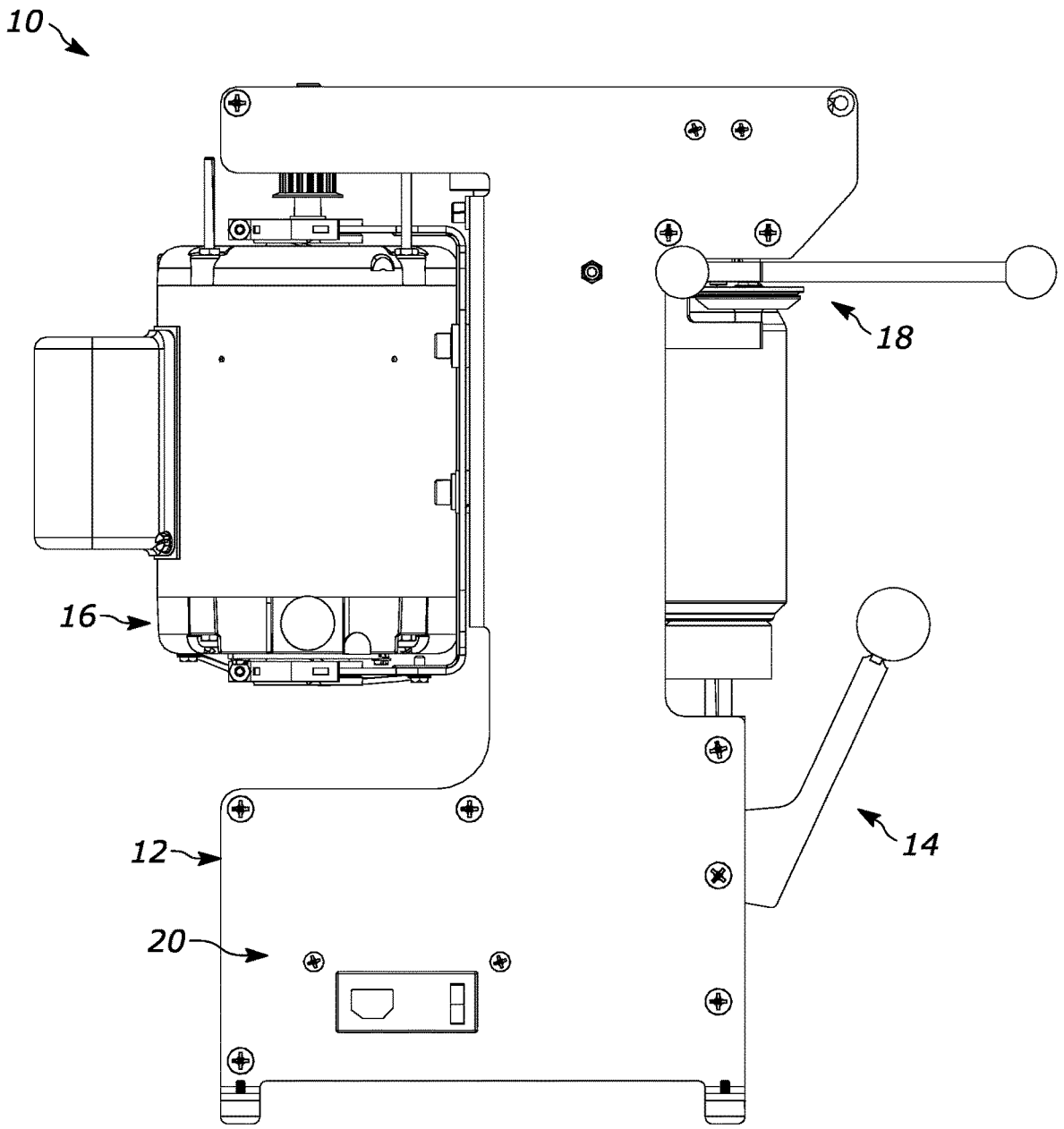
FIG. 3 of the drawings is a side elevational view of the can seaming apparatus of the present disclosure.
Figure 4:
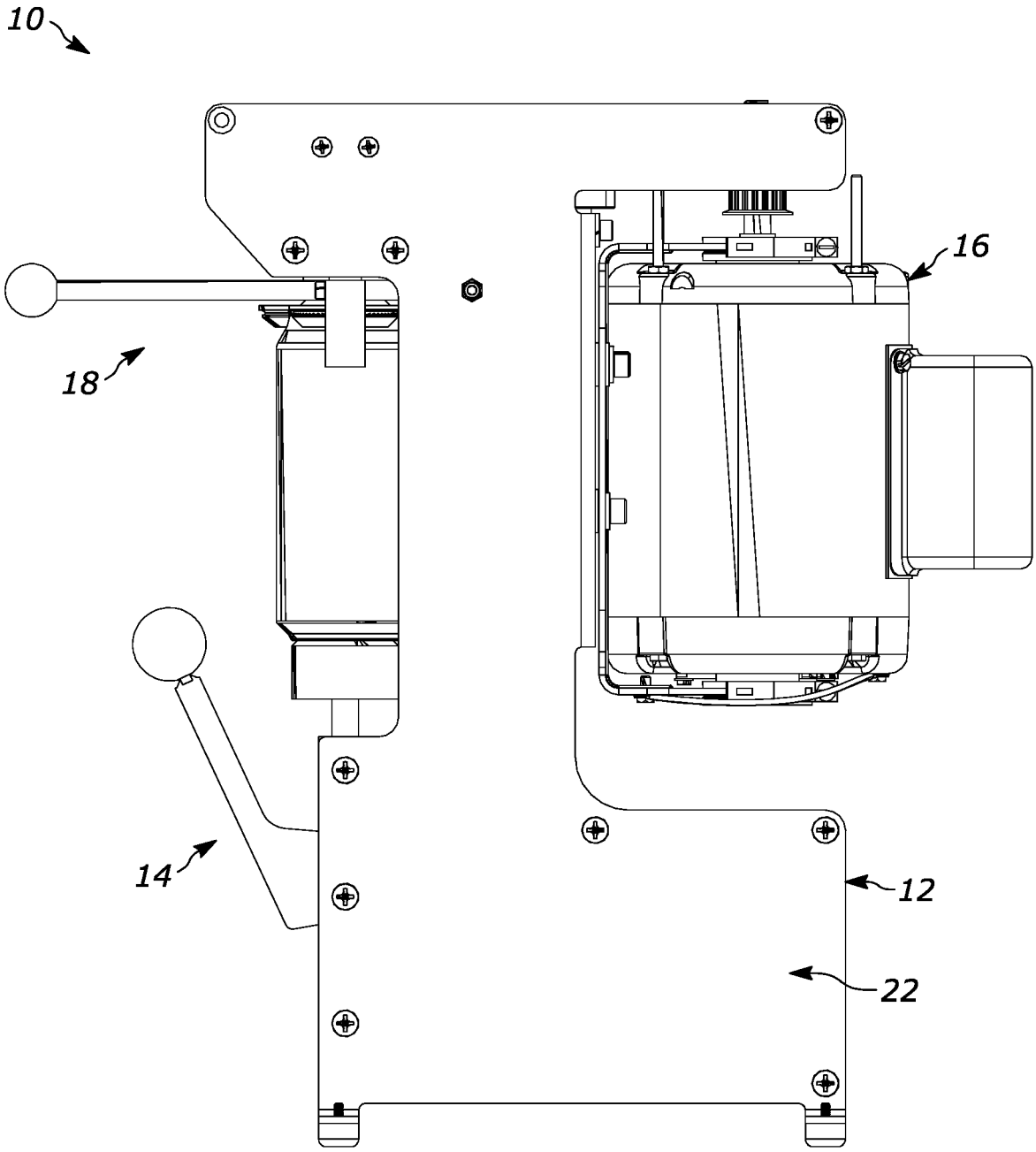
FIG. 4 of the drawings is a side elevational view of the can seaming apparatus of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 16:
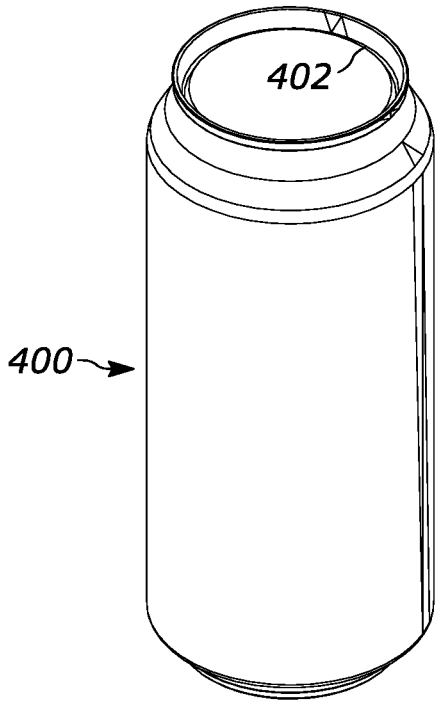
FIG. 16 of the drawings is a perspective view of a can blank having a cap thereon.

Referring now to the drawings and in particular to FIGS. 1 through 4, the can seaming apparatus is shown generally at 10. The can seaming apparatus includes frame 12, can handling assembly 14, can driving assembly 16 and seam forming assembly 18. The can seaming apparatus is configured to be manually operated (although automation is likewise contemplated with respect to the seam forming assembly). As set forth above, such a configuration allows for the inexpensive and efficient self-canning and sealing of cans, such as can 400 (FIG. 16), by an individual or a relatively small operation.

In the configuration shown, the frame 12 is shown as comprising a plurality of panels and beams coupled together. It will be understood that a number of different configurations are contemplated, as the frame provides a basis upon which to couple to other components of the apparatus. In the configuration shown, the frame includes first sidewall 20 and second sidewall 22. The sidewalls comprise substantially planar members that are substantially parallel to each other and spaced apart from each other, forming the outer sides of the apparatus. A plurality of cross members, such as cross member 24 are coupled to each of the sidewalls and span therebetween to couple and fix the sidewalls relative to each other.

A motor mount 26 extends across between the sidewalls and is coupled thereto. The motor mount is positioned toward the back of the frame 12. The frame 12 further includes structures to which the can handling, can driving and seam forming assemblies are coupled to the upper mounting plate 28 and the lower mounting plate 29. The upper mounting plate 28 includes top surface 30 and bottom surface 32. The lower mounting plate 29 includes central opening 34, which includes upper bore 36 and lower bore 38 which are co-linear with each other and extend through the central opening 34.

Figure 5:
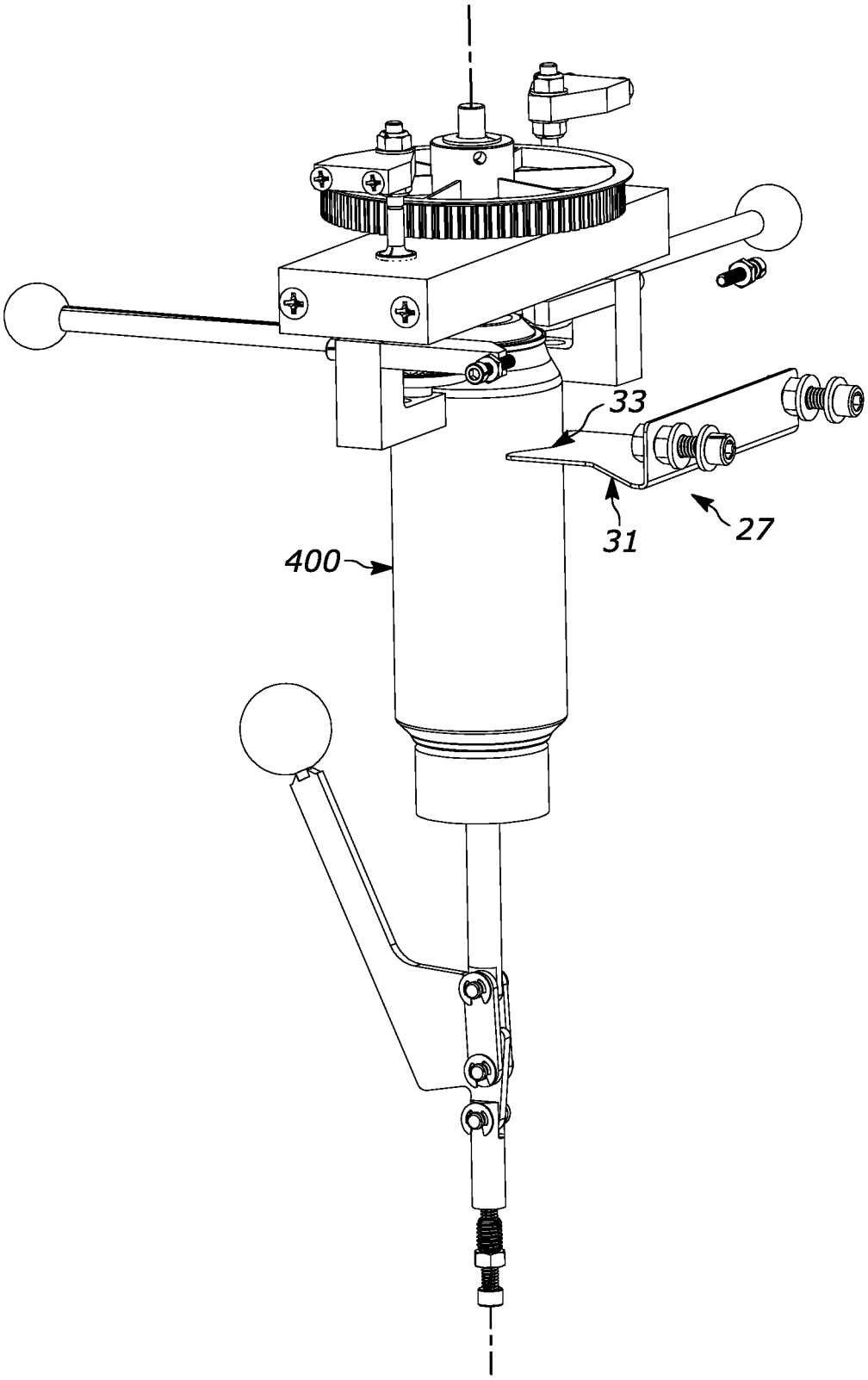
FIG. 5 of the drawings is a perspective view of the can handling assembly as well as the can positioning bracket of the can seaming apparatus of the present disclosure.
Figure 6:
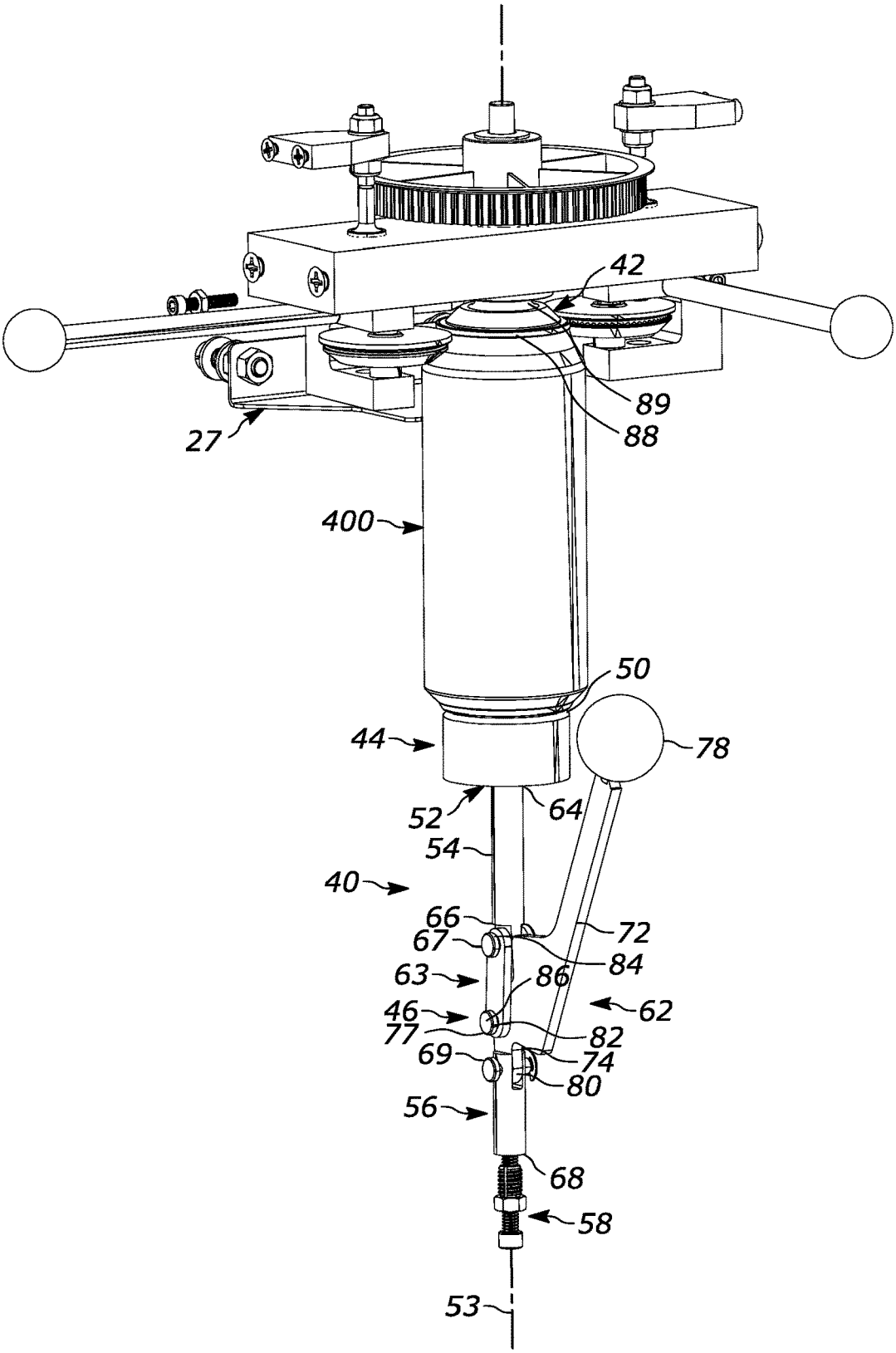
FIG. 6 of the drawings is a perspective view of the can handling assembly, showing, in particular, the lower end can handling subassembly.

With reference to FIG. 5, the frame may further include a can positioning bracket 27 that extends from the motor mount 26 toward the region of the can 400. The can positioning bracket 27 includes outward body 31 and inner edge 33. The outward body extends from the motor mount toward the can region, terminating in inner edge 33. The inner edge comprises a concave portion that has an inflection point that is aligned with the axis 53 of the can handling assembly. Other configurations that likewise foster alignment of the can are contemplated, some of which align directly with the axis 53 and some of which may be offset therefrom. As will be explained in the operation, can 400 can be placed on the lower chuck 44 and forced against the inner edge 33 of the can positioning bracket. As the can is raised into contact with the upper chuck, due to the relative dimensions of the upper chuck and the can, the upper chuck grabs and pulls the can away from the inner edge 33 and into position. That is, the inner edge 33 is positioned in such a manner that the upper chuck will pull/direct/urge the can away from the inner edge 33 while aligning the same along the axis 53.

Figure 8:
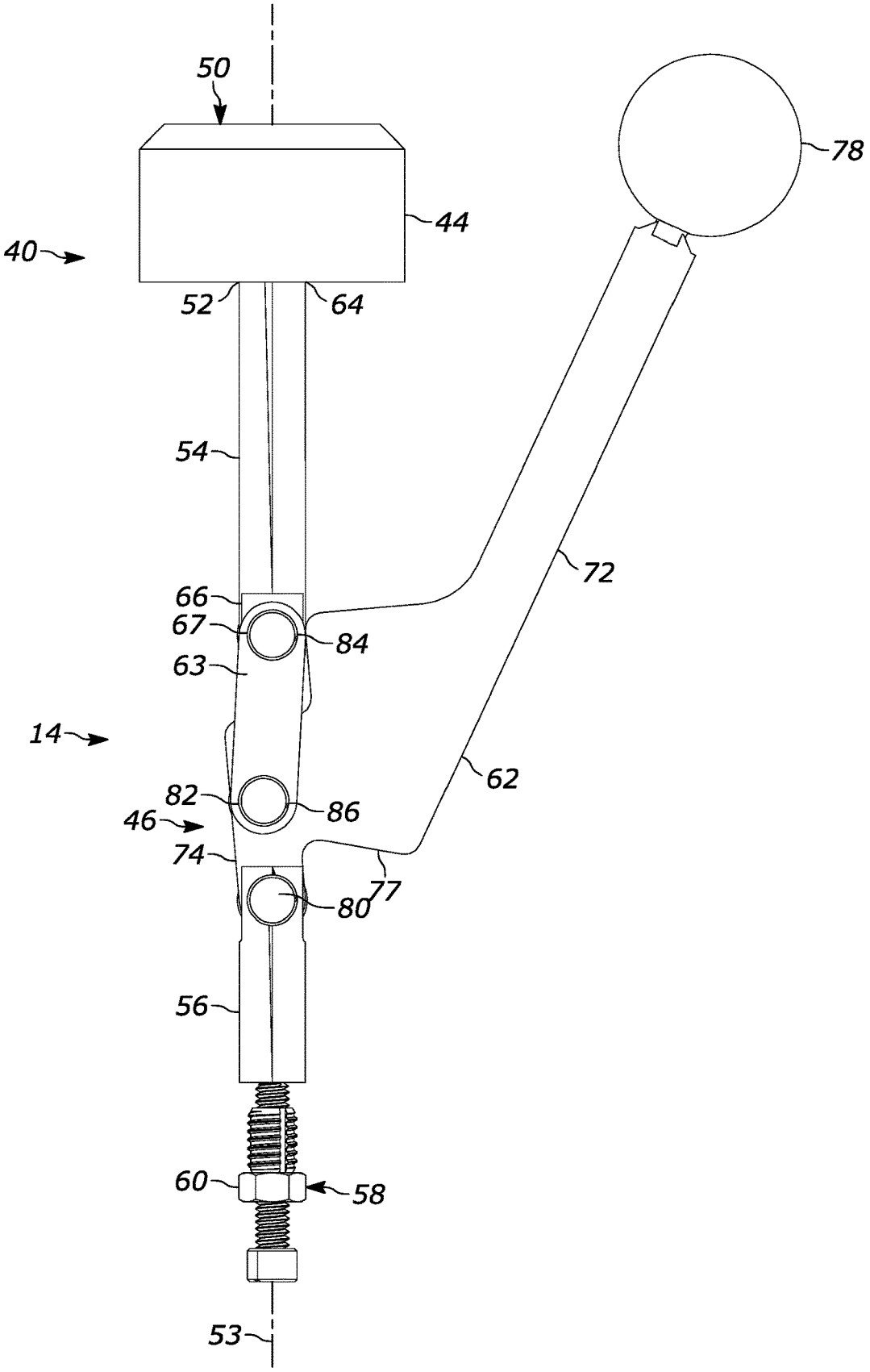
FIG. 8 of the drawings is a perspective view of the lower end can handling assembly of the can seaming apparatus of the present disclosure.
Figure 9:
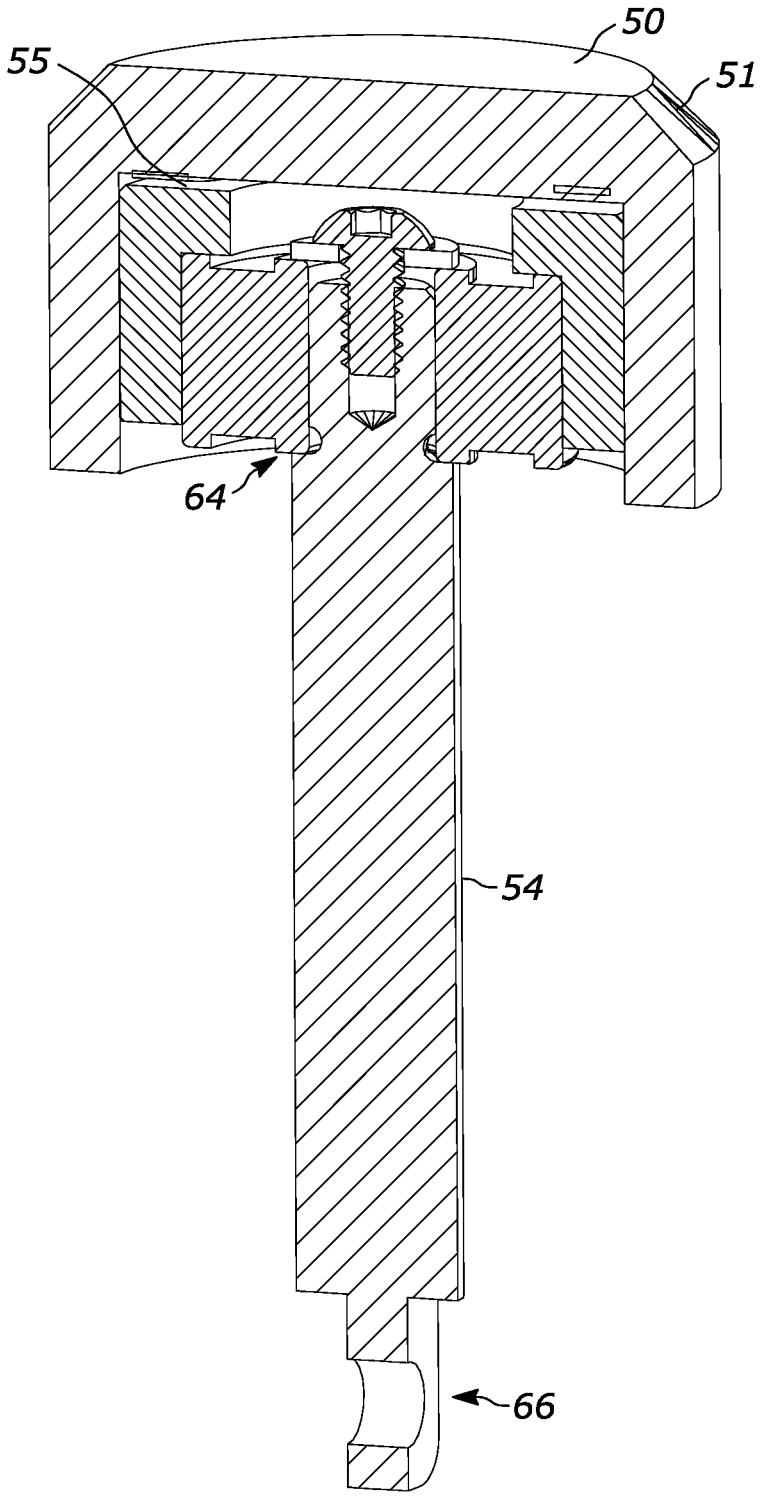
FIG. 9 of the drawings is a cross-sectional view of the lower chuck, showing the biasing member thereof along with the upper push rod.

The can handling assembly 14 is shown in FIGS. 5, 8 and 9 as including lower end can handling subassembly 40 and upper end can handling subassembly 42. The lower end can handling subassembly 40 includes lower chuck 44, lower can positioning subassembly 46. Lower chuck 44 includes upper surface 50 and lower axle opening 52. The axle opening 52 defines axis of rotation 53. The upper surface of the lower chuck 44 is configured to matingly engage the lower surface of a can blank, such as can blank 400. The can blank generally comprises a conventional, typically aluminum, can blank that has an outer lower rim with a generally outwardly concave, or domed configuration. The upper surface of the lower chuck is configured to engage with the outer lower rim and concave configuration so that the can positioned thereon rotates about its central axis which matches the central axis of the lower chuck. In the configuration shown, the can is merely placed on the lower chuck, and the lower chuck does not include gripping means or the like (although some type of gripping means are contemplated).

In more detail, and with particular reference to FIG. 9, the upper surface 50 includes an outer chamfer or configuration 51 which facilitates the centering of the can 400 when positioned thereon. The chamfer can engage or direct/urge/push the can into the proper orientation on the lower chuck. The lower chuck may further include a biasing member 55 (in this configuration, a spring washer or wave spring) that biases the upper surface 50 toward the upper chuck. This allows for some biasing force when clamped through the overcenter mechanism.

The lower can positioning subassembly 46 includes upper push rod 54, lower clamp rod 56, adjustment mechanism 58, locking screw 60, overcenter handle 62 and linkage 63. The lower can positioning subassembly 46, in the configuration shown, comprises an overcenter mechanism which can slidably direct the lower chuck upwardly and downwardly and lock the same in the upper position. As will be explained below, such movement can lock, in a clamping manner, the can between the upper and lower chucks.

The upper push rod 54 includes first end 64 and second end 66. The first end 64 is coupled to the lower axle opening 52 of the lower chuck 44 and defines the axis of rotation of the lower chuck 44. The second end 66 includes axle 67 (or opening 67 configured to receive an axle so as to define an axis of rotation or pivotable coupling). The upper push rod 54 extends through upper bore 36 of the lower mounting plate 29. The lower clamp rod 56 includes first end 68 and second end 69. The lower clamp rod 56 extends through the lower bore 38 of the lower mounting plate 29. The lower clamp rod is positioned in the same axis as the upper push rod. The adjustment mechanism 58 is threadedly engaged to the lower end of the lower bore 38 of the lower mounting plate 29, and can direct the lower clamp rod 56 further into the central opening of the lower mounting plate or recede the lower clamp rod 56 from the central opening. It will be understood that the lower adjustment mechanism can be further inserted or receded from the lower mounting plate by rotating the adjustment mechanism in opposing directions. A locking screw (not shown) may be employed through the lower mounting plate and into the lower bore 38, engaging the lower clamp rod 56, and, through a clamping force, locking the lower clamp rod, and precluding inward and outward movement thereof.

The overcenter handle 62 includes arm 72 and lever portion coupling 74. The lever portion coupling 74 includes lower pivot connection 80 and upper pivot connection 82. The two pivot connections are spaced apart from each other. The arm extends outwardly therefrom and includes first end 77 that is proximate the two pivot connections and second end 78 which is spaced apart therefrom. The arm provides the leverage necessary to rotate the lever arm relative to the linkage and the lower clamp rod, as will be explained. The linkage 63 includes first pivot connection 84 and second pivot connection 86.

The overcenter mechanism is formed by coupling the lower pivot connection 80 of the lower portion coupling 74 of the overcenter handle 62 to the lower clamp rod 56. The linkage 63, and in particular, the first pivot connection 84 is coupled to the axle 67 of the second end of the upper push rod 54, and the second pivot connection 86 is coupled to the upper pivot connection 82 of the lever portion coupling of the overcenter handle. As the handle is rotated about the lower clamp rod, the upper push rod is directed in an upward direction relative to the lower mounting plate 29. At some point the handle member reaches a point at which further rotation is not permitted, at which time, the handle can be locked in such apposition (assuming that there is an opposite force on the lower chuck—which would be caused by a can sandwiched, or clamped, between the upper and lower chucks). The handle, as will be explained below, can be rotated in the opposite direction, to direct the lower chuck back down, toward the lower mounting plate 29.

The upper end handling subassembly includes upper chuck 48 which includes lower surface 88 and upper axle opening 89. The lower surface is configured to matingly engage the upper cap 402 of the can which is resting on the upper outwardly directed flange of the can. The upper chuck is configured to releasably maintain the upper cap in the desired orientation and to allow for the rotation of the can about its central axis.

Figure 10:
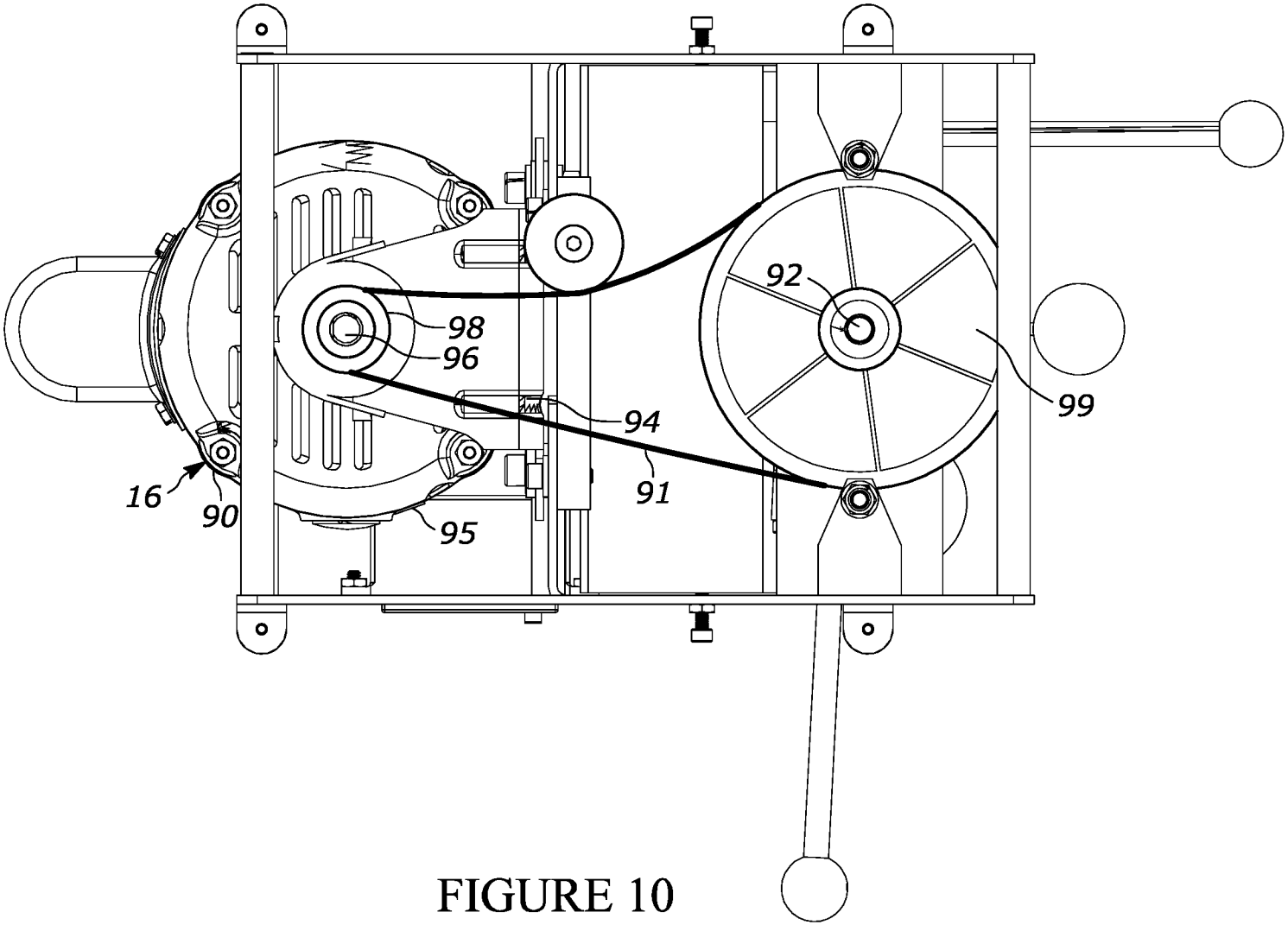
FIG. 10 of the drawings is a top plan view of can seaming apparatus of the present disclosure, showing, in particular the driving assembly thereof.
Figure 11:
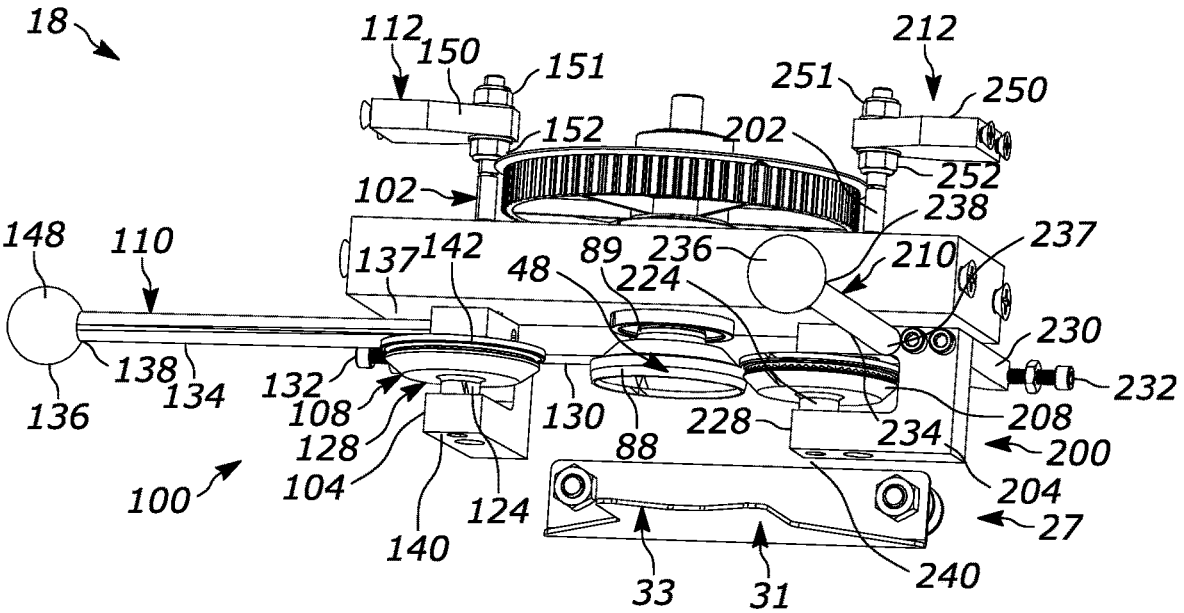
FIG. 11 of the drawings is a perspective view of the can handling assembly and the seam forming assembly of the can seaming apparatus of the present disclosure.
Figure 11:
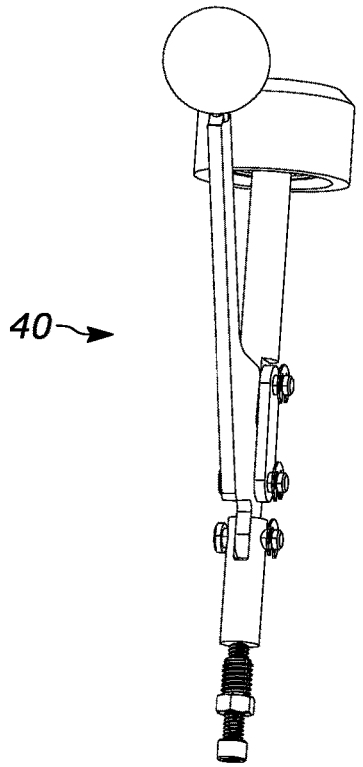
Figure 12:
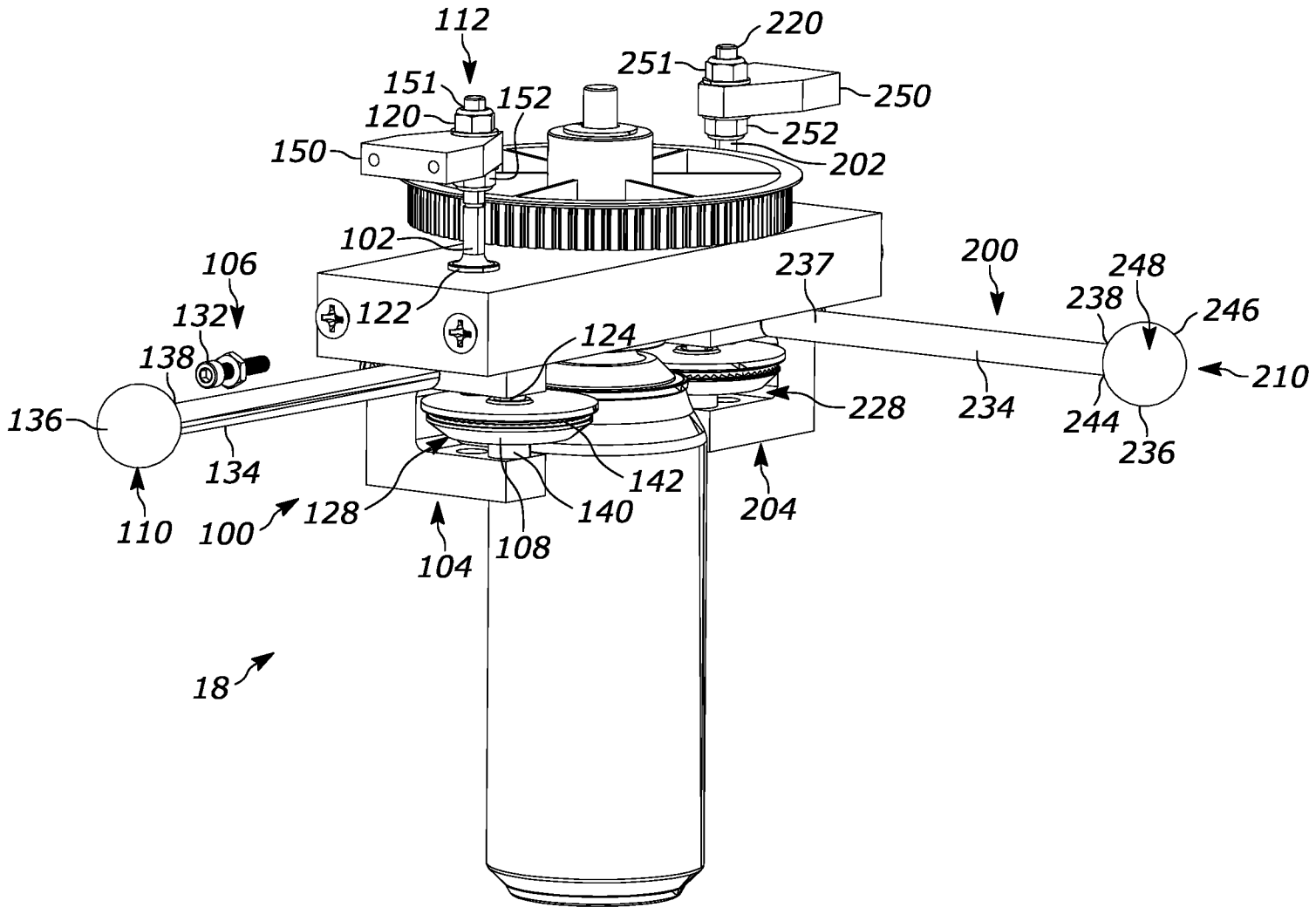
FIG. 12 of the drawings is a perspective view of the can handling assembly and the seam forming assembly of the can seaming apparatus of the present disclosure.
Figure 13:
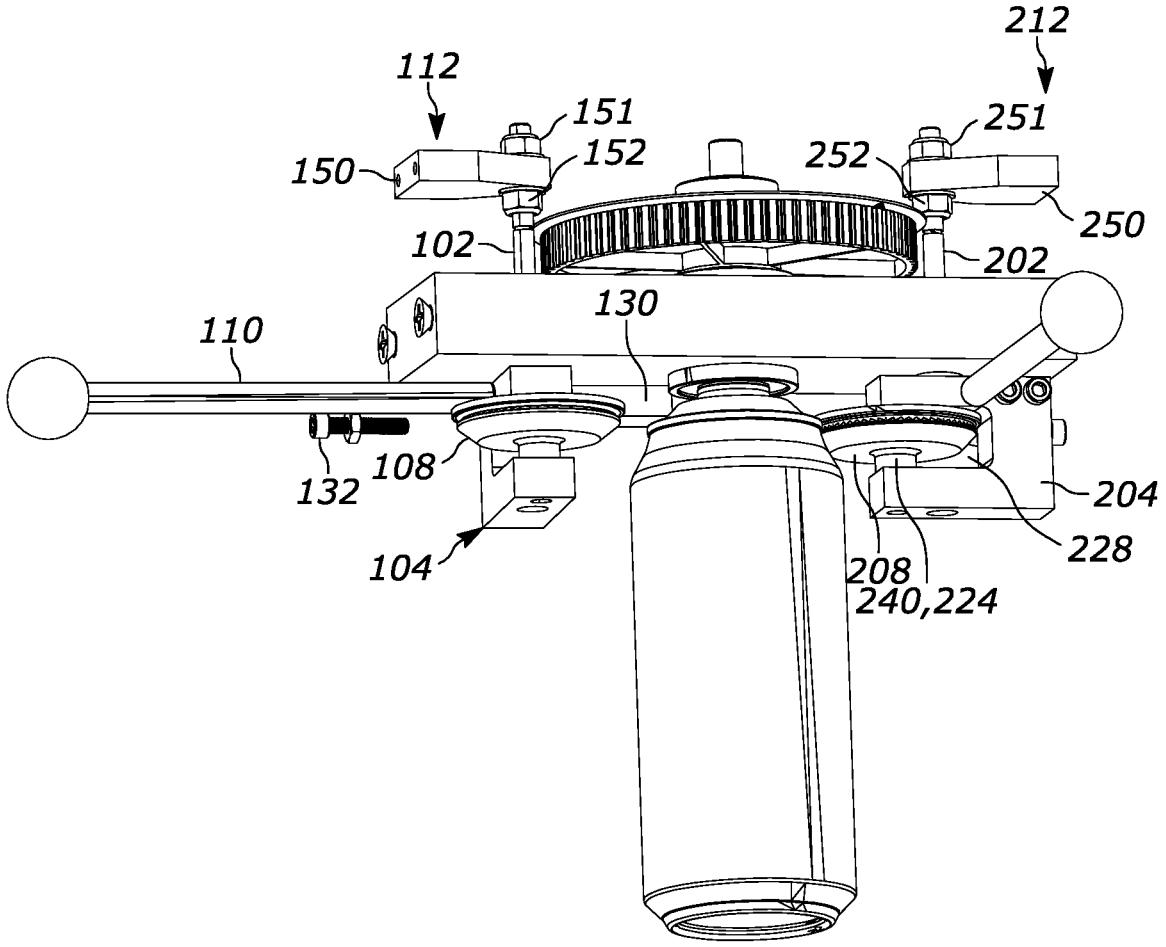
FIG. 13 of the drawings is a perspective view of the can handling assembly and the seam forming assembly of the can seaming apparatus of the present disclosure.
Figure 14:
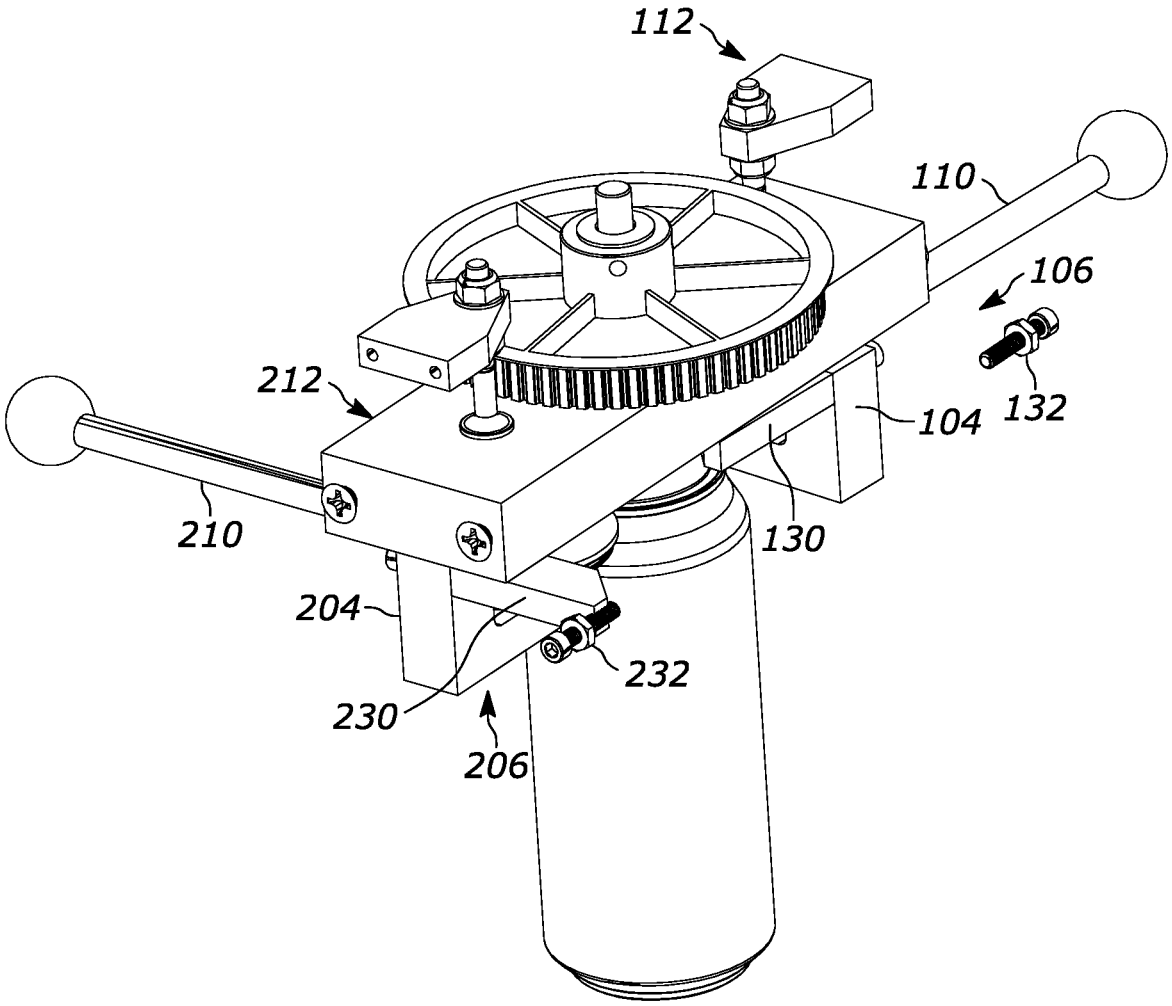
FIG. 14 of the drawings is a perspective view of the can handling assembly and the seam forming assembly of the can seaming apparatus of the present disclosure.
Figure 15:
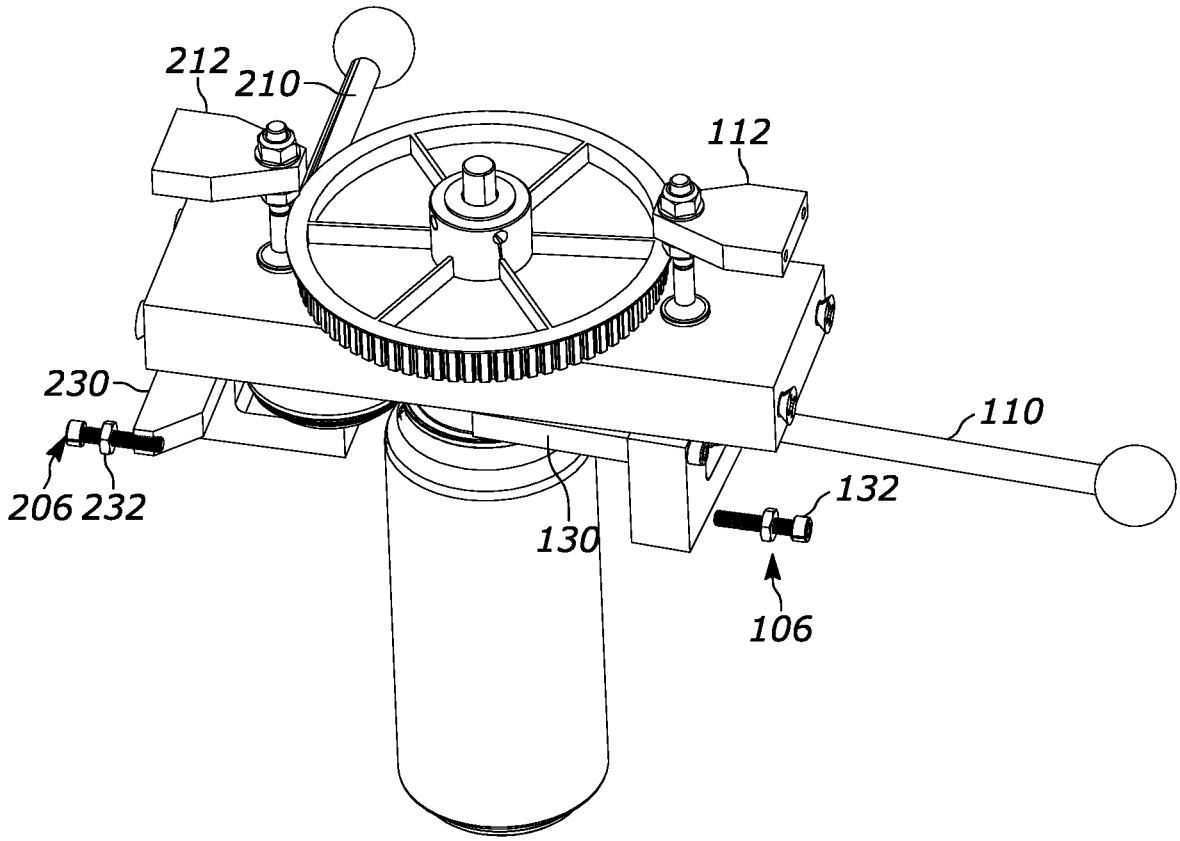
FIG. 15 of the drawings is a perspective view of the can handling assembly and the seam forming assembly of the can seaming apparatus of the present disclosure.

The can driving assembly 16 is shown in FIG. 10 as comprising motor 90, chuck axle 92 and transmission system 94. The motor 90 is mounted in a vertical orientation on the motor mount 26, on a back surface thereof. The motor 90 includes housing 95 and axle 96, which axle extends substantially vertically from the housing 95. The chuck axle 92 extends through the upper mounting plate 28 and is coupled to the upper axle opening 89. The transmission system 94 includes motor pulley 98, can pulley 99 and belt 91. The motor pulley 98 is fixed to the axle 96 of the motor with the can pulley coupled to the chuck axle 92. The belt rotatably couples the two pulleys. The two pulleys are sized so that the motor rotates at a faster rate than the can. Of course the precise ratio between the two can be varied and can be determined through different means for different types of cans and the like. It will be understood that the motor and the pulleys are generally fixed to the frame and substantially precluded from adjustment (although variations are contemplated). A tensioner or idler may be positioned in the path of the belt to provide the necessary tension on the belt, so as to preclude slippage and the like.

The seaming assembly 18 is shown in FIGS. 11 through 15 as comprising first seam forming subassembly 100 and second seam forming assembly 200. It will be understood that the roller profiles that the seam forming assemblies form onto the can are known in the art. Thus, the actual profiles of the rollers can be varied depending on the particular container or the particular configuration of the double can seam that is applied.

The first seam forming assembly and the second seam forming assembly operate on opposing sides of the can so that one of the seam forming assembly can be applied to the can first, followed by the other seam forming assembly. By positioning the two seam forming assemblies on opposing sides, the two have little chance of inadvertently interacting with each other, and can be operated by opposite hands virtually simultaneously. The two seam forming subassemblies are substantially mirror images of each other. As such, similar structures are denoted by the same reference number augmented by 100 for the second seam forming subassembly.

The first seam forming subassembly 100 includes first pivot axle 102, first roller trunnion 104, first roller 108, first pivot limiting assembly 106, first rotation actuator 110 and first roller position adjustment 112. The first pivot axle 102 extends through the upper mounting plate 28 spaced to one side of the upper chuck. The first pivot axle 102 includes first end 120 and second end 122. The first end 120 may include a threaded portion which, as will be explained, allows for adjustment.

The first roller trunnion 104 is coupled to the second end 122 of the first pivot axle 102, and generally has a c-channel shape with a slot 128 formed therein. The first roller 108 is placed in the slot 128 of the first roller trunnion 104 and includes axis 140 and outer periphery 142. The axis 140 is coupled to the roller mount axle 124. The outer periphery 142 defines the first roller profile. The first roller profile is utilized to fold over the cover curl of the can top over the flange of the can and to push inwardly the flange. The first roller freely rotates about the roller mount axle 124.

The first pivot limiting assembly 106 limits the range of pivoting (or rotation) of the first seam forming subassembly relative to the first pivot axle 102. The first limiting assembly 106 includes stop member 130 and limit adjustment screw 132. The stop member 130 extends from the first roller trunnion 104. The limit adjustment screw extends through the frame and can interface with the stop member 130. In particular, As the assembly is rotated about the first pivot axle, the stop member 130 is precluded from further movement by contacting the limit adjustment screw 132 coupled to the frame. By turning the limit adjustment screw, the screw can be moved further away or closer to the stop member, thereby changing the amount of pivoting of the assembly about the first pivot axle. It will be understood that the adjustment can be made so that the first roller properly contacts the can and properly applies the first profile to form the first portion of the fold.

The first rotation actuator 110 includes lever 134 and handle 136. The lever 134 includes proximal end 137 and distal end 138. The proximal end 137 is fixedly coupled to the first roller trunnion 104, with the second end extending outwardly therefrom. It will be understood that the lever 134 is positioned so as to provide a mechanical advantage and to allow rotation of the first roller trunnion about the first pivot axle 102. The mechanical advantage serves to provide the user with ample strength to forcibly direct the profile on the outer periphery of the first roller 108 against the can. In other configurations, the handle may be omitted, and, a single lever may be utilized (in place of two levers that are on opposite sides of a handle). The lever may include a sphere or other element at the end thereof to facilitate grasping.

The handle 136 essentially comprises a ball or spherical object that is at the second end thereof. In other configurations, the handle may comprise a member that extends generally perpendicularly to the lever 134 in a downward direction. In other configurations, the handle may be oblique to the lever and may extend either upwardly or downwardly from the lever. The handle may include an outer surface 148 which may be covered with a flexible material to enhance comfort to the user. The particular configuration of the handle is not of particular importance, other than the handle provides the user a comfortable means by which to engage and move the lever to direct the rotation of the first roller and to provide the necessary force against the can to form the desired movement of the portions of the can.

The first roller position adjustment system 112 includes adjustment bracket 150, upper fastener 151 and lower fastener 152. In the configuration shown, the fasteners can be loosened to move the first pivot axle (which is threaded) in either an upward or downward direction relative to the adjustment bracket 150. In the configuration shown, the adjustment bracket is coupled to the first sidewall 20 of the frame 12. Once adjusted as desired, the fasteners can be tightened. It will be understood that when raising the pivot axle, the lower fastener can be loosened to allow for travel while the upper fastener is tightened to move the pivot axle upward. The opposite can be done to lower the pivot axle.

Figure 7:
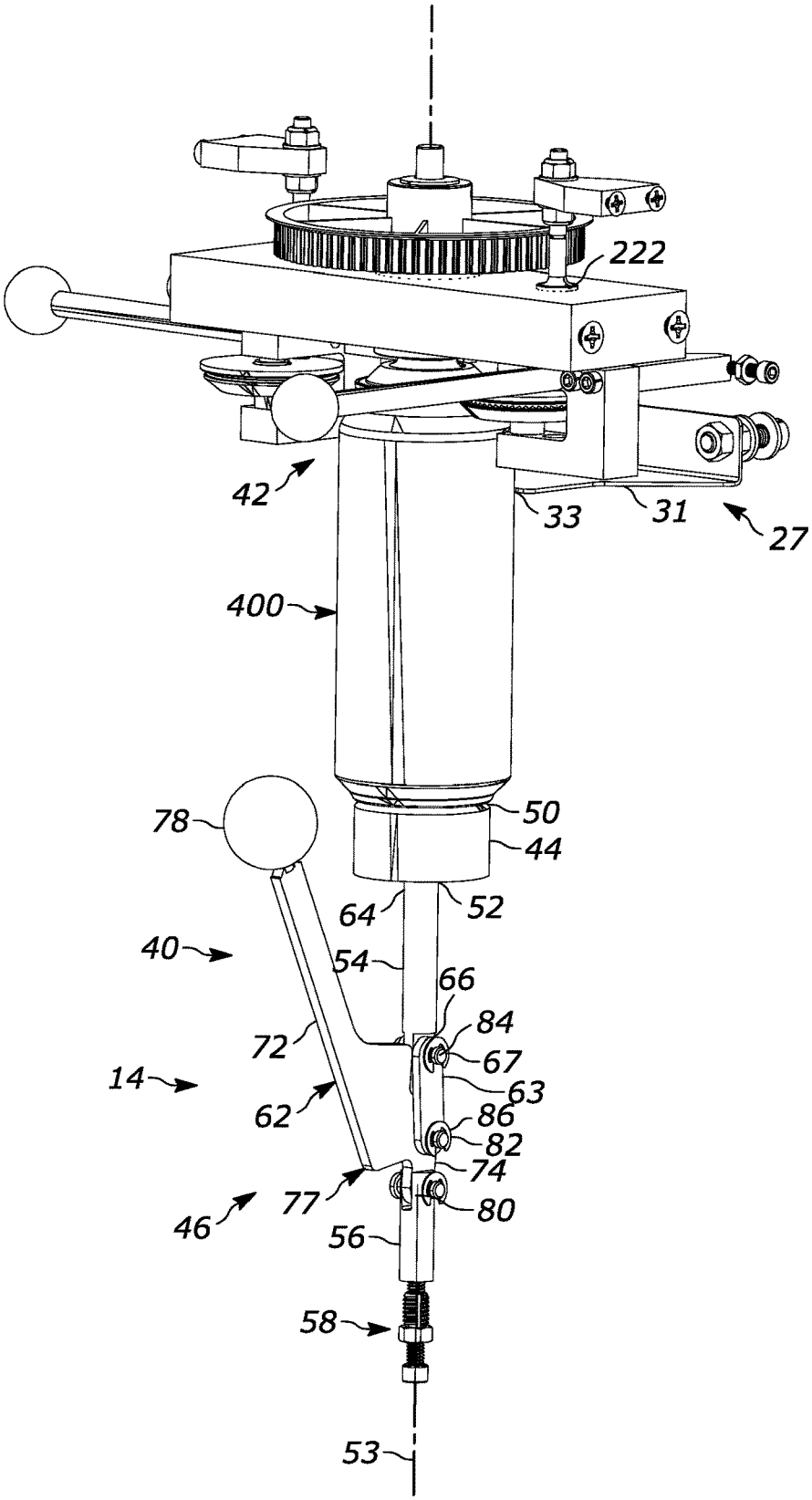
FIG. 7 of the drawings is a perspective view of the can seaming apparatus of the present disclosure, showing, in particular, the lower end can handling subassembly.

Another configuration of the first roller position adjustment system 112 is shown in FIG. 7 of the incorporated provisional from which the present application claims priority, as comprising adjustment bracket 150, adjuster 151, and fastener 152. The first roller position adjustment system 112 provides vertical adjustment to the first roller relative to the frame so as to adjust the location relative to the upper and lower chuck that the roller enters the space of the can (and would contact the can). In the configuration shown, the bracket 150 is positioned on the top surface of the upper mounting plate opposite the first roller 108. In the configuration shown, the bracket 150 straddles the first end of the pivot axle 102, and includes a bore that is substantially concentric with the first pivot axle 102. The adjuster 151 is threaded into the bore and coacts with the first end 120 of the first pivot axle 102.

In such a configuration, the fastener 152 extends about the first end of the pivot axle so as to lock. As such, the rotation of the fastener 152 directs the first pivot axle 102 in an upward or downward direction relative to the upper mounting plate. Once positioned in the desired orientation, the adjuster 151 can be tightened against the first end 120 of the first pivot axle. Once tightened, the fastener can be rotated to further tighten or to make small adjustments. From time to time, adjustments can be made to the vertical position of the first roller 108.

Referring again to FIGS. 11 through 15, the second seam forming subassembly 200 includes second pivot axle 202, second roller trunnion 204, second roller 208, second pivot limiting assembly 206, second rotation actuator 210, and second roller position adjustment system 212. The second seam forming assembly 200 is on the opposite side of the can relative to the first seam forming subassembly 100. As noted above, the similar configurations of the second seam forming subassembly 200 have the same reference numbers as the first seam forming subassembly 100 augmented by 100.

In short, the second pivot axle 202 includes first end 220 and second end 222 (FIG. 7). The second roller trunnion includes roller mount 224 having slot 228. The second roller 208 is positioned within the slot 228 about axis 240 within the c-channel formed in the second roller trunnion.

The second pivoting limiting assembly 206 includes stop member 230 and limit adjustment screw 232. The second rotation actuator 210 includes lever 234 and handle 236. The lever 234 includes proximal end 237 and the distal end 238. The handle 236 includes first end 244, second end 246 and outer surface 248. The second roller position adjustment system 212 includes adjustment bracket 250, upper fastener 251 and lower fastener 252.

The operation of the various components of the second seam forming subassembly 200 have essentially a mirror like function relative to the first seam forming subassembly 100. It will be understood that the axis of rotation of the upper and lower chucks, and the rollers, as well as the pivot axles is substantially parallel and offset relative to each other (while variations are contemplated). Additionally, the first seam forming subassembly and the second seam forming assembly are on opposing sides of the upper and lower chucks, so as to minimize interference, and to allow for two handed operation through the respective levers and handles. Of course, the two seam forming rollers have different profiles so as to form the necessary seam, as will be described.

In operation, the user first is provided with the can seaming apparatus 10. The user next obtains a can 400 in an unassembled condition. The can is positioned on the upper surface of the lower chuck. The configuration of the upper surface of the lower chuck, and including the chamfered outer rim provides assistance and urges or otherwise directs the can into the proper orientation. It will be understood that different chucks can be employed depending on the size or configuration of a can. It is contemplated that a set of lower chucks may be provided or available to handle different configurations of cans.

At the same time, the can is inserted into the can region of the apparatus, and pushed or directed into contact with the inner edge 33 of the can forming bracket 27. It will be understood that when pressed against the inner edge 33, the can is slightly out of alignment relative to the axis 53 (in the configuration shown).

Once positioned, The overcenter handle is rotated by grasping the arm. In particular, as the arm rotates, the lower chuck is directed in an upward direction, along with the can. Eventually, the can lid contacts the lower surface of the lower chuck. As the position of the inner edge 33 places the can close enough to the axis 53, the upper chuck pulls the can away from the inner edge 33 and into alignment with axis 53. When in alignment, the can sides are spaced apart from the inner edge 33, preferably, so that when rotating, the can stays spaced apart from the inner edge 33 so it is not marred or destroyed. Such a configuration allows for simple positioning during attachment of the can to insure that it can easily be positioned in the desired orientation. At the same time, the can forming bracket 27 does not mar or generally contact the rotating can. In other configurations, the bracket 27 may remain in contact with the can when aligned. In such configurations, the bracket may include rollers or other structures which limit marring and friction between the components.

At this time, the arm reaches a position where the linkages are all generally axial, and further movement directs the lever portion of the overcenter handle in an overcenter position, thereby locking the overcenter mechanism is locked in position.

In this locked position, the can is firmly sandwiched (or clamped) between the upper and lower chucks and substantially precluded from movement relative to either of the chucks. It will be understood that there may be a variation in the dimensions of a can. In such a configuration, the biasing member may be sufficient to accommodate the variation in dimensions. It will be understood that other lower chucks may be swapped in and out to accommodate differently sized cans.

In other such instances, it may be necessary to make an adjustment to the lower can positioning subassembly. In particular, it may be that in the overcenter locked configuration, the distance between the upper and lower chuck is greater than the can to such an extent that the can is not clamped tightly enough by the upper and lower chucks. In other configurations, it may be that the distance between the upper and lower chucks is not as large as the can. In such an instance, attempted clamping of the can between the upper and lower chucks can result in damage to the can. As elaborated upon above, the biasing member or spring (such a wave spring) that can be positioned within the lower chuck further aids adjustability. This can take up the difference in can height at the maximum and minimum tolerances, without requiring readjustment of the lower chuck. Additionally, the lower assembly may have some elasticity to facilitate adjustment for can height within certain limits.

In either instance where the upper and lower chucks are not configured properly to clamp the can, the lower can positing subassembly can be adjusted. Specifically, the lower clamp rod can be moved relative to the lower mounting plate. Next, the adjustment mechanism can be altered which can direct the lower clamp rod up or down, to selectively increase or decrease the upward movement of the lower chuck relative to the upper chuck. Once the desired adjustment is reached, the locking screw can be tightened, which locks the lower clamp rod to the lower mounting plate.

Once the can is clamped, and in an engaging configuration, the can is spun on its central axis 53 along with the upper and lower chucks. To spin the can, the motor is actuated. The power of the motor rotates the motor pulley which transfers the power via the belt to the can pulley. The can rotates at a predetermined speed based on the relative size of the motor pulley and the cam pulley. It will be understood that a number of different configurations are contemplated, including constant speed motors and variable speed motors. Additionally, it will be understood that the pulleys may be replaced with differently sized pulleys so as to alter the speed at which the can spins about its axis.

Once the can reaches sufficient speed, the top of the can is crimped to the can to form the double can seal. This is achieved by first directing the first roller into contact with the can and the top, to initiate the formation of the double can seal. Next, the second roller is directed into contact with the can and the top to finish the double can seal. In more detail, the user first grasps the handle of the first seam forming subassembly and rotates the lever thereof about the first pivot axle. Eventually, the roller comes into contact with the can and initiates the crimping of the top of the can with the can. So that the roller does not apply too great a force on the can, the stop member eventually contacts the limit adjustment screw precluding further rotation.

Once the first crimping deformation is applied by the first roller, the handle is rotated in the opposite direction to direct the first roller away from the can. The can is now ready to be crimped by the second roller, to complete the double can seal. In particular, through virtually the same procedure as with the first seam forming subassembly, the second handle is grasped, and the second roller is rotated about the second pivot axle. The rotation continues until the second roller contacts the can and the can top. As the roller is further rotated, the roller applies the crimping deformation to complete the double can seal. The rotation of the roller is limited and ceases when the stop member contacts the limit adjustment screw, precluding further rotation.

Once the second roller has applied the final crimping step, the second roller can be rotated about the second pivot axle to move the second roller away from the can. At such time, the can is fully formed and sealed.

It will be understood that, from time to time, it may become necessary to adjust the relative vertical position of the rollers relative to the upper chuck (to adjust for different cans or different seal structures). To adjust either of the position of the first or second roller, in the vertical position, the respective one of the roller position systems are adjusted. For example, as set forth above, the fasteners can be selectively loosened and tightened in the proper order to effectuate vertical upward and downward movement. Once positioned into the desired orientation, the fasteners can be tightened to maintain the desired position. A similar procedure can be instituted to adjust the vertical position of the second roller.

It may from time to time be desirable to adjust the amount of rotation of the roller relative to the can. As set forth above, the rotation of the roller relative to the can is limited by the interaction between the stop member and the limit adjusting member. That is, when the stop member contacts the limit adjusting member, further rotation of the roller relative to the first pivot axle is precluded. To reduce the range of rotation, the limit adjusting member is adjusted to contact the stop member sooner, whereas to increase the range of rotation, the limit adjusting member is adjusted to contact the stop member after greater rotation. The first roller range and the second roller range can be independently adjusted as desired. Advantageously, this adjustment can be made from outside of the frame. Additionally, the top cover can be easily removed and replaced to provide access to the vertical adjustment of the rollers.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A can seaming apparatus comprising:

a frame;

a lower chuck rotatably mounted to the frame and structurally configured to retain a lower rim of a blank of a can, and an upper chuck rotatably mounted to the frame and structurally configured to retain an upper cap of the can, the lower chuck translatable toward and away from the upper chuck, with the upper chuck and the lower chuck rotating about an axis of rotation;

a motor coupled to one of the upper chuck and the lower chuck so as to be rotatable about the axis of rotation; and first seam forming subassembly including a first roller rotatably coupled to a first roller trunnion, the first roller trunnion being pivotably coupled to the frame about a first pivot axle to define a roller side and a handle side of the first roller trunnion, the first pivot axle being spaced apart from an axis of rotation of the first roller on the roller side of the first roller trunnion, with a first lever extending outwardly from the first roller trunnion on the handle side of the first roller trunnion, and a first stop member extending outwardly from the handle side of the first roller trunnion in a direction opposite that of the first lever so that the first lever is on one side of the first pivot axle and the first stop member is on an opposite side of the first pivot axle with both being on the handle side of the first roller trunnion, the first stop member being interfaceable with a first screw that is adjustably threadedly coupled to the frame within a corresponding threaded opening fixed to the frame, whereupon the first screw limits the pivoting of the first roller trunnion relative to the frame in a first direction; and a second seam forming subassembly including a second roller rotatably coupled to a second roller trunnion, the second roller trunnion being pivotably coupled to the frame about a second pivot axle to define a roller side and a handle side of the second roller trunnion, the second pivot axle being on a side opposite the first pivot axle, the second pivot axle being spaced apart from an axis of rotation of the second roller on the roller side of the second roller trunnion, with a second lever extending outwardly from the second roller trunnion on the handle side of the second roller trunnion, and a second stop member extending outwardly from the handle side of the second roller trunnion in a direction opposite that of the second lever so that the second lever is on one side of the second pivot axle and the second stop member is on an opposite side of the second pivot axle with both being on the handle side of the first second roller trunnion, the second stop member being interfaceable with a second screw that is adjustably threadedly coupled to the frame within a corresponding threaded opening fixed to the frame, whereupon the second screw limits the pivoting of the second roller trunnion relative to the frame in a second direction.

2. The can seaming apparatus of claim 1 further including a first roller position adjustment, adjusting the vertical position of the first roller relative to the upper chuck, so as to alter a point of contact on the at least one of the blank and the top cap.

3. The can seaming apparatus of claim 2 wherein the axis of rotation of the first pivot axle and the first roller is parallel to the axis of rotation of the upper chuck and the lower chuck.

4. The can seaming apparatus of claim 1 wherein the first pivot axle and the second pivot axle are parallel to each other and parallel to the axis of rotation of the upper and lower chuck.

5. The can seaming apparatus of claim 4 wherein each of the first and second pivot axles include an adjustment mechanism, which selectively alters a vertical position of the first roller relative to the upper chuck, and a vertical position of the second roller relative to the upper chuck, so as to alter a point of contact of the first roller and the second roller, respectively, on the at least one of the blank and the upper cap of the can.

6. The can seaming apparatus of claim 5 wherein the first pivot axle is positioned on one side of the upper chuck, and the second pivot axle is positioned on a second side of the upper chuck.

7. The can seaming apparatus of claim 6 wherein the first roller and the second roller are each configured to contact the at least one of the blank and the upper cap of the can on opposite sides.

8. The can seaming apparatus of claim 1 wherein the first trunnion comprises a c-channel shape defining a first slot, with the first roller being rotatably positioned within the first slot, the first lever extending from a first side of the c-channel shape, and the first stop member extending from a second side of the c-channel shape on the handle side thereof.

9. The can seaming apparatus of claim 8 wherein the first lever extends perpendicularly from the first side of the c-channel shape and the stop member extends perpendicularly from the second side of the c-channel shape on the handle side thereof.

10. The can seaming apparatus of claim 8 wherein the second trunnion comprises a c-channel shape defining a second slot, with the second roller being rotatably positioned within the second slot, the second lever extending from a first side of the c-channel shape, and the second stop member extending from a second side of the c-channel shape on the handle side thereof.

11. The can seaming apparatus of claim 10 wherein the second lever extends perpendicularly from the first side of the c-channel shape and the stop member extends perpendicularly from the second side of the c-channel shape on the handle side thereof.

12. The can seaming apparatus of claim 1 wherein the axis of rotation, the first pivot axle and the second pivot axle are coplanar.

13. The can seaming apparatus of claim 1 wherein the frame includes a first sidewall and a second sidewall, the first screw being threadedly engaged with the first sidewall and the second screw being threadedly engaged with the second sidewall.

* * * * *